US012618643B2

(12) United States Patent
Jensen

(10) Patent No.: US 12,618,643 B2
(45) Date of Patent: May 5, 2026

(54) HANDLESS SHOULDER-FIRE FIREARM CARRY SYSTEM

(71) Applicant: Melvon Jensen, Juneau, AK (US)

(72) Inventor: Melvon Jensen, Juneau, AK (US)

( * ) Notice: Subject to any disclaimer, the term of this patent is extended or adjusted under 35 U.S.C. 154(b) by 160 days.

(21) Appl. No.: 18/375,158

(22) Filed: Sep. 29, 2023

(65) Prior Publication Data

US 2025/0109927 A1 Apr. 3, 2025

(51) Int. Cl.
*F41C 33/04* (2006.01)
*F41C 33/00* (2006.01)

(52) U.S. Cl.
CPC ..... *F41C 33/046* (2013.01); *F41C 33/005* (2013.01); *F41C 33/007* (2013.01)

(58) Field of Classification Search
CPC ..... F41C 33/046; F41C 33/005; F41C 33/007
USPC ..... 224/149
See application file for complete search history.

(56) References Cited

U.S. PATENT DOCUMENTS 2,873,902 A * 2/1959 Decker ..... F41C 33/007 224/257
3,501,074 A 3/1970 Emerick
5,642,847 A 7/1997 DeMeo
5,893,370 A * 4/1999 Perez ..... A41D 13/0012 2/94
6,363,532 B1 * 4/2002 Miller et al. ..... F41C 33/003 2/102
8,943,730 B2 * 2/2015 Ascano ..... F41C 33/007 42/94
9,243,867 B2 1/2016 Ponder
9,581,414 B1 * 2/2017 Mironski ..... F41C 33/046
9,683,809 B2 6/2017 Fowler
9,784,531 B1 10/2017 Baker
9,797,679 B2 10/2017 Ponder
9,879,943 B2 * 1/2018 Ray ..... F41C 33/003
9,897,412 B1 2/2018 Cicero, Jr
11,168,957 B2 11/2021 Cass
2009/0321484 A1 * 12/2009 Schweikert ..... F41C 33/002 224/268
2013/0276343 A1 * 10/2013 Peters ..... F41C 33/007 29/469
2014/0263489 A1 * 9/2014 Hendricks ..... F41C 33/002 29/401.1
2016/0238341 A1 * 8/2016 Ray ..... F41C 33/003
(Continued)

FOREIGN PATENT DOCUMENTS

WO WO2015126882 8/2015

*Primary Examiner* — Peter N Helvey

(57) ABSTRACT

A handless shoulder-fire firearm carry system for securing a shoulder-fire style firearm to a user moving in a walking pace or in a running pace includes a firearm including a frame having a first section, a second section, and a center section. A belt is worn about a waist of the user. An anchor is coupled to the belt and secures the firearm to the belt. A vest is worn on a torso of the user. The vest holds the firearm in a downward position relative to the user. A pair of securing attachments is coupled to the firearm. Each of the securing attachments facilitates securing the firearm to the anchor. The pair of securing attachments includes a first securing attachment facilitating securing the first section of the firearm to the anchor and a second securing attachment facilitating securing the center section of the firearm to the anchor.

10 Claims, 15 Drawing Sheets

(56) References Cited

U.S. PATENT DOCUMENTS

| | | | | |
|---|---|---|---|---|
| 2021/0285740 | A1* | 9/2021 | Wessels | F41C 33/007 |
| 2022/0136788 | A1* | 5/2022 | Caudle | F41A 11/02 42/18 |

* cited by examiner

HANDLESS SHOULDER-FIRE FIREARM CARRY SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to firearm holsters and more particularly pertains to a new firearm holster for securing a shoulder-fire style firearm to a user moving in a walking pace or in a running pace.

(2) Description of Related Art Including Information Disclosed Under 37 CFR 1.97 and 1.98

The prior art relates to firearm holsters and includes a variety of firearm holsters securing a rifle-style firearm or a shotgun-style firearm to a front or a back of a user. The prior art does not include a firearm holster securing the rifle-style firearm or the shotgun-style firearm to the side of the user in a downward position such that the user is able to move in a walking pace or a running pace without the firearm becoming unsecured from the users intended carry position.

BRIEF SUMMARY OF THE INVENTION

An embodiment of the disclosure meets the needs presented above by generally comprising a firearm including a frame having a first section, a second section, and a center section positioned between the first section and the second section. A belt is configured to be worn about a waist of the user. An anchor is coupled to the belt and is configured to secure the firearm to the belt. A vest is configured to be worn on a torso of the user. The vest holds the firearm in a downward position relative to the user. A rear carry position is defined by the second section and the center section of the firearm being positioned between the user and the vest and the first section or the second section of the firearm being attached to the anchor positioned at a rear of the user. A side carry position is defined by the center section and the second section being positioned between the user and the vest and the center section being attached to the anchor positioned at a side of the user. A pair of securing attachments is coupled to the firearm. Each of the securing attachments is configured to facilitate securing the firearm to the anchor. The pair of securing attachments includes a first securing attachment facilitating rear carry by securing the first section of the firearm to the anchor positioned at the rear of the user and a second securing attachment facilitating front or side carry by securing the center section of the firearm to the anchor positioned at a front of the user or a side of the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
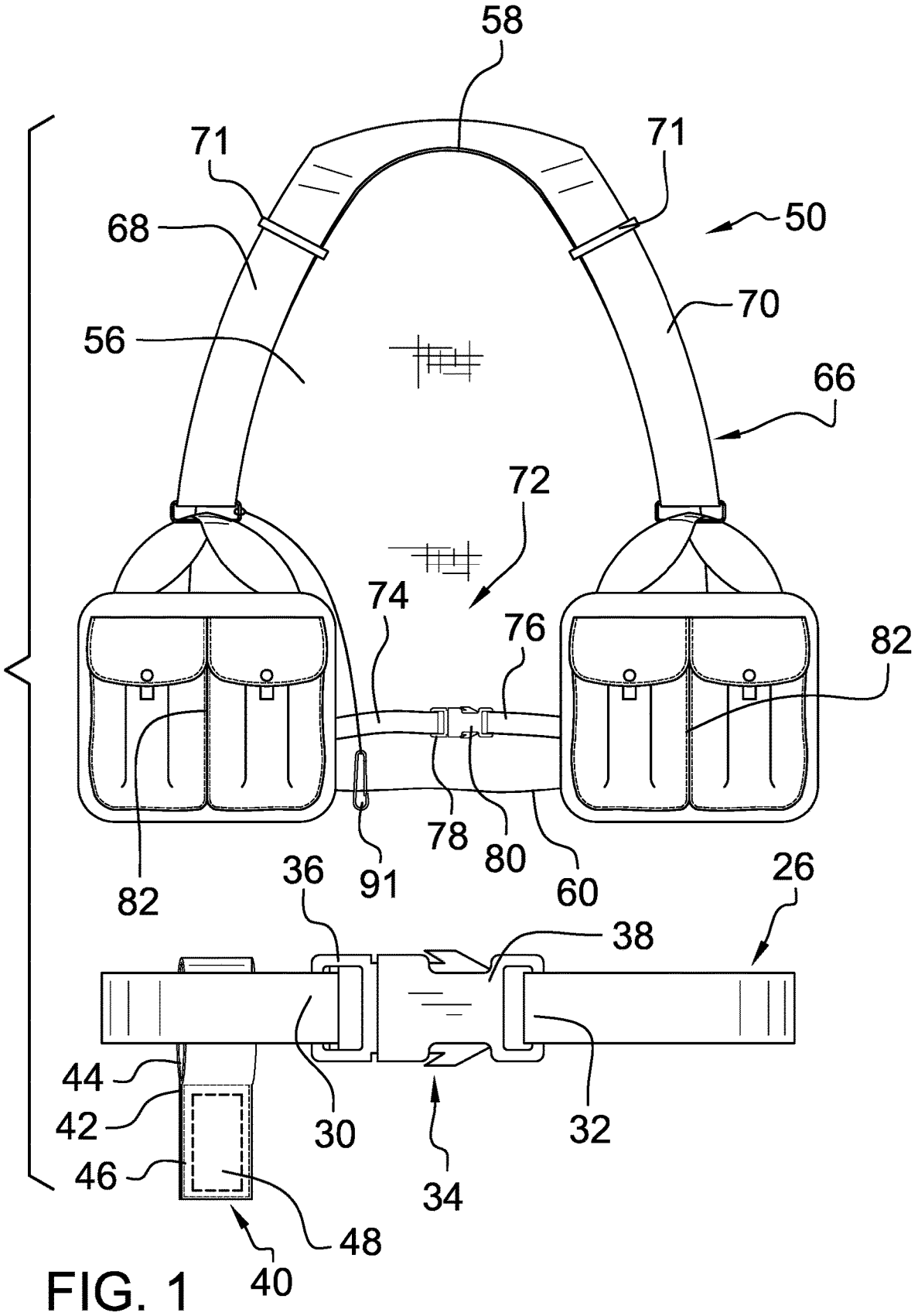
FIG. 1 is a front view of a handless shoulder-fire firearm carry system according to an embodiment of the disclosure.
Figure 2:
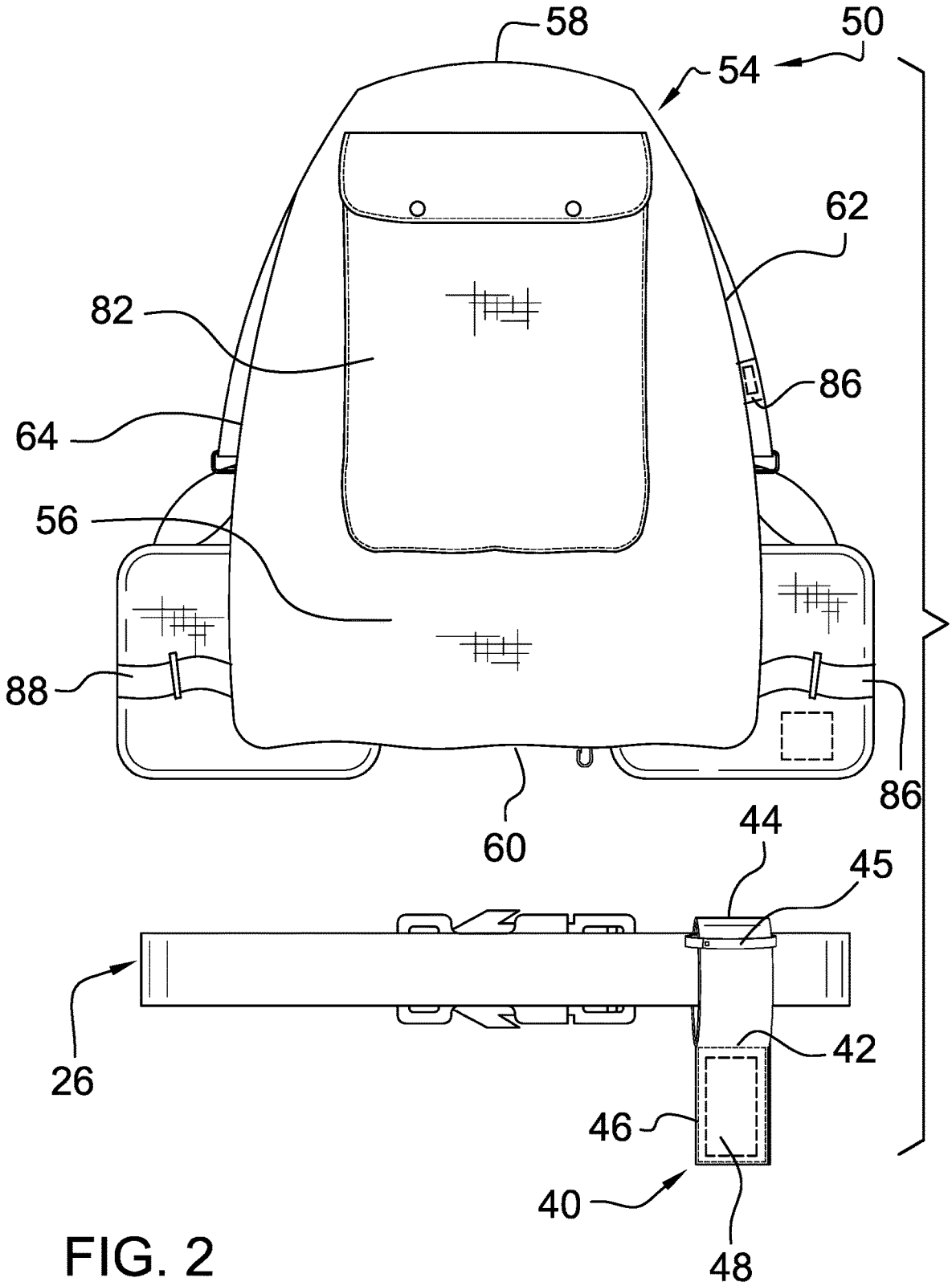
FIG. 2 is a rear view of an embodiment of the disclosure.
Figure 3:
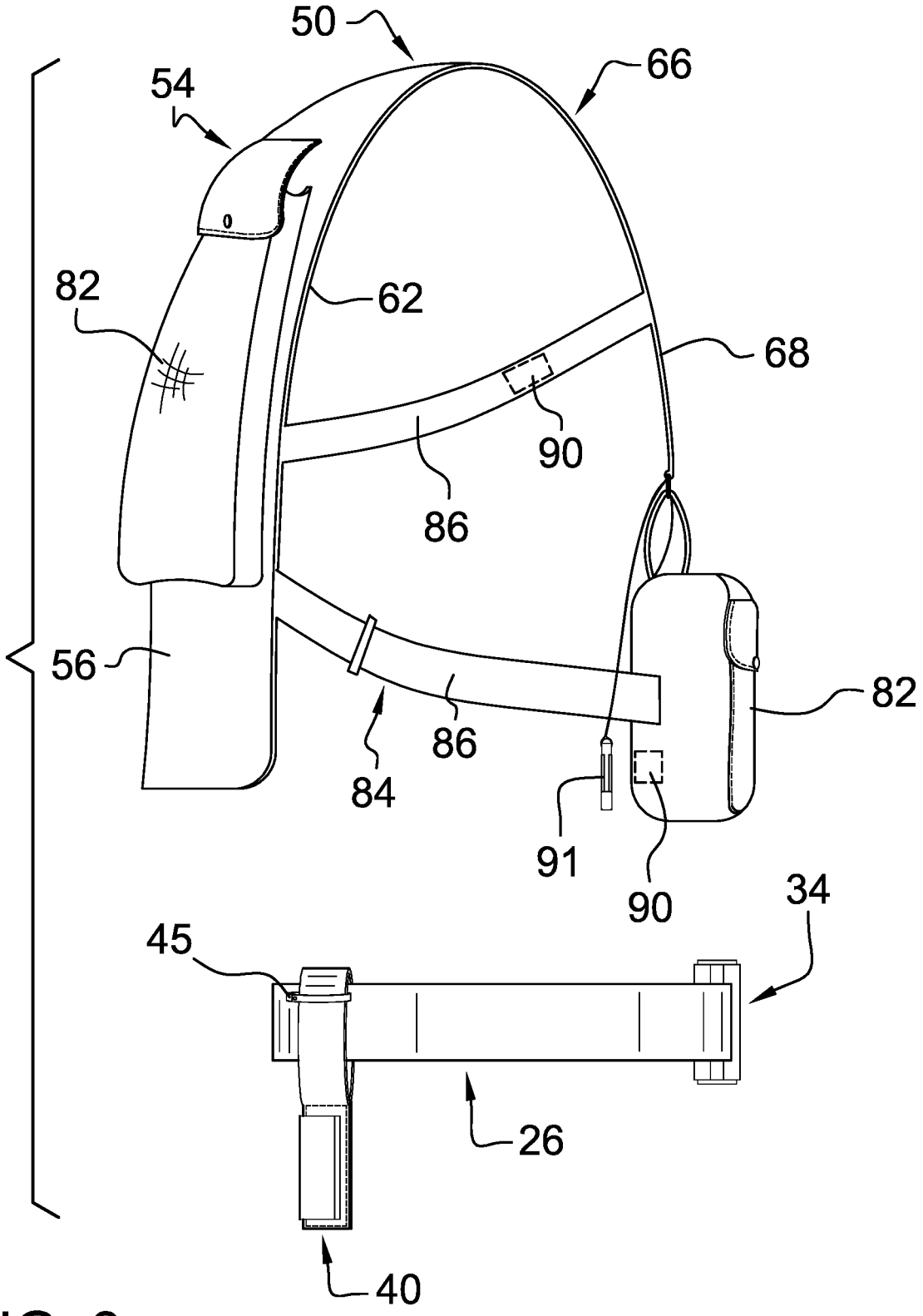
FIG. 3 is a side view of an embodiment of the disclosure.
Figure 4:
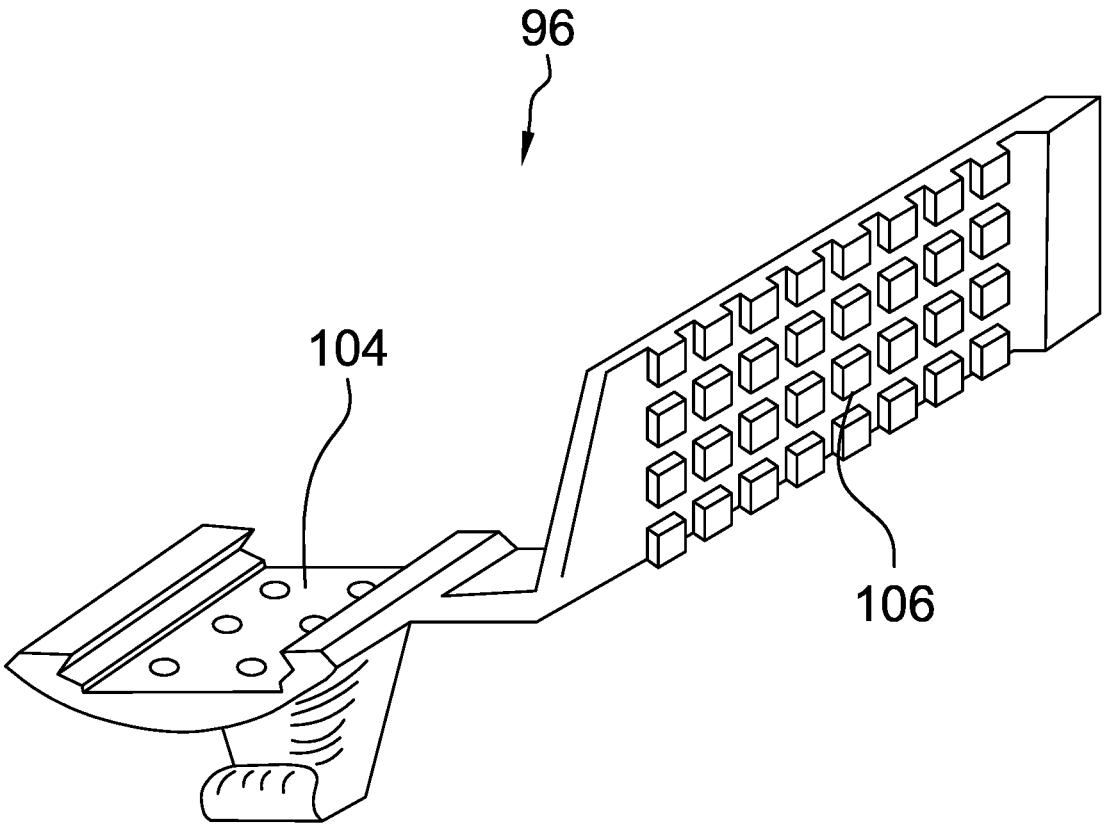
FIG. 4 is a detail view of an embodiment of the disclosure.
Figure 5:
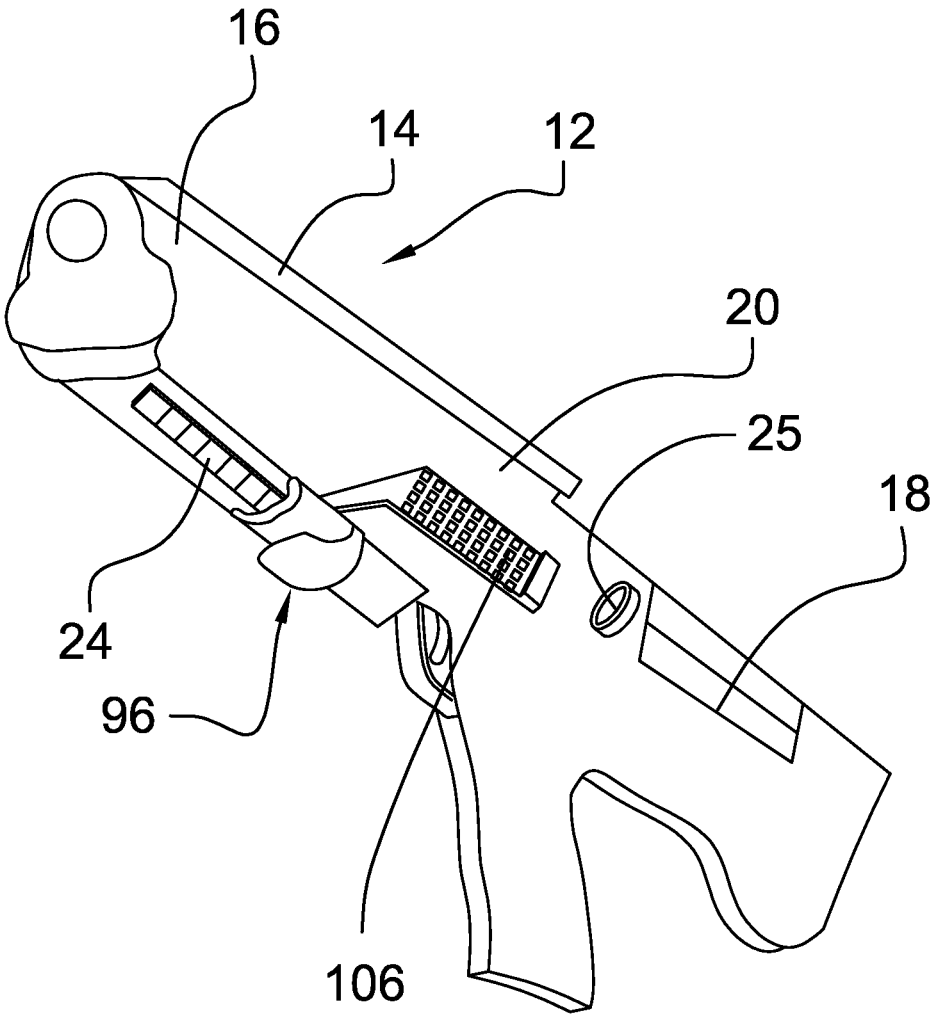
FIG. 5 is a detail view of an embodiment of the disclosure.
Figure 6:
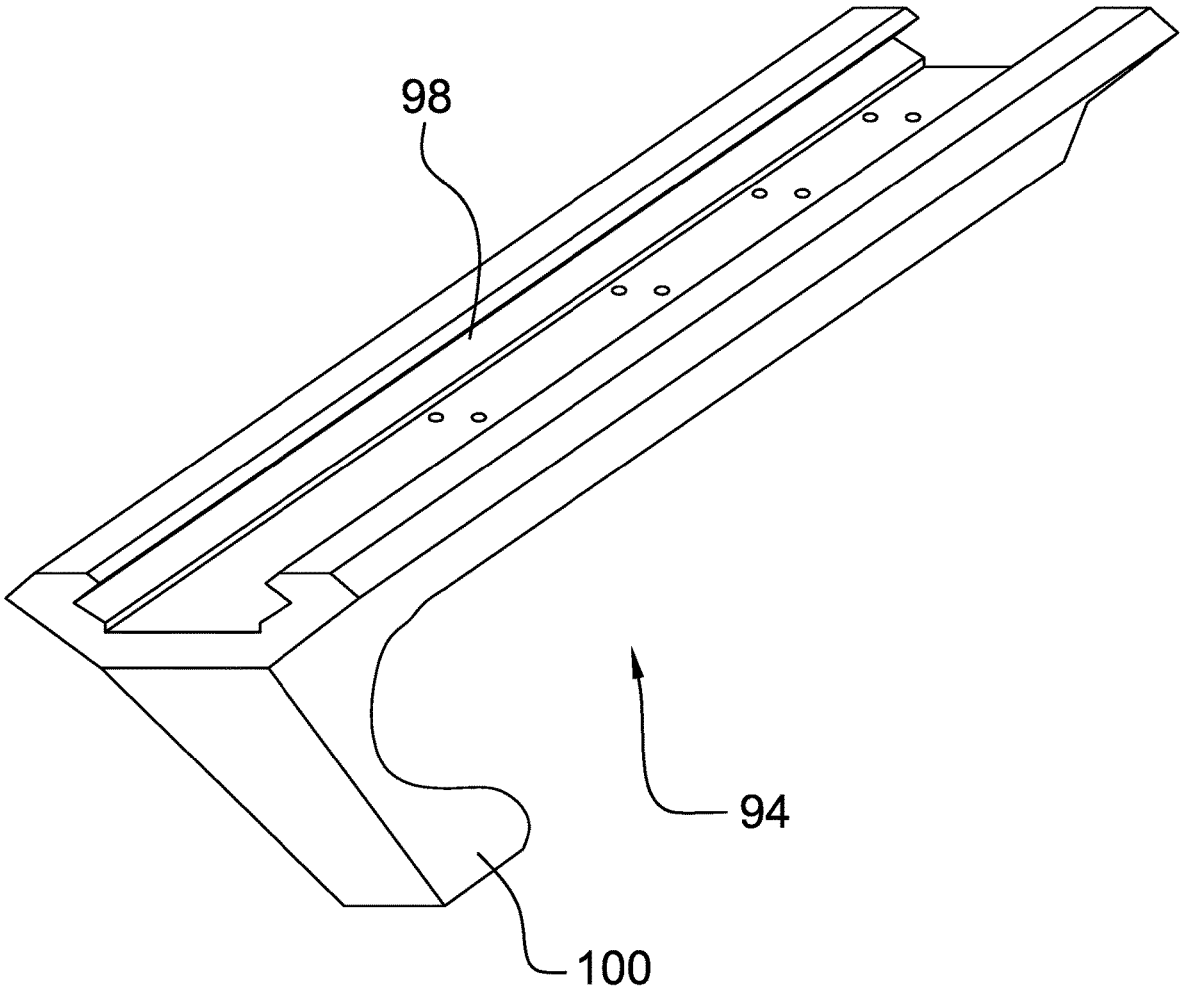
FIG. 6 is a detail view of an embodiment of the disclosure.
Figure 7:
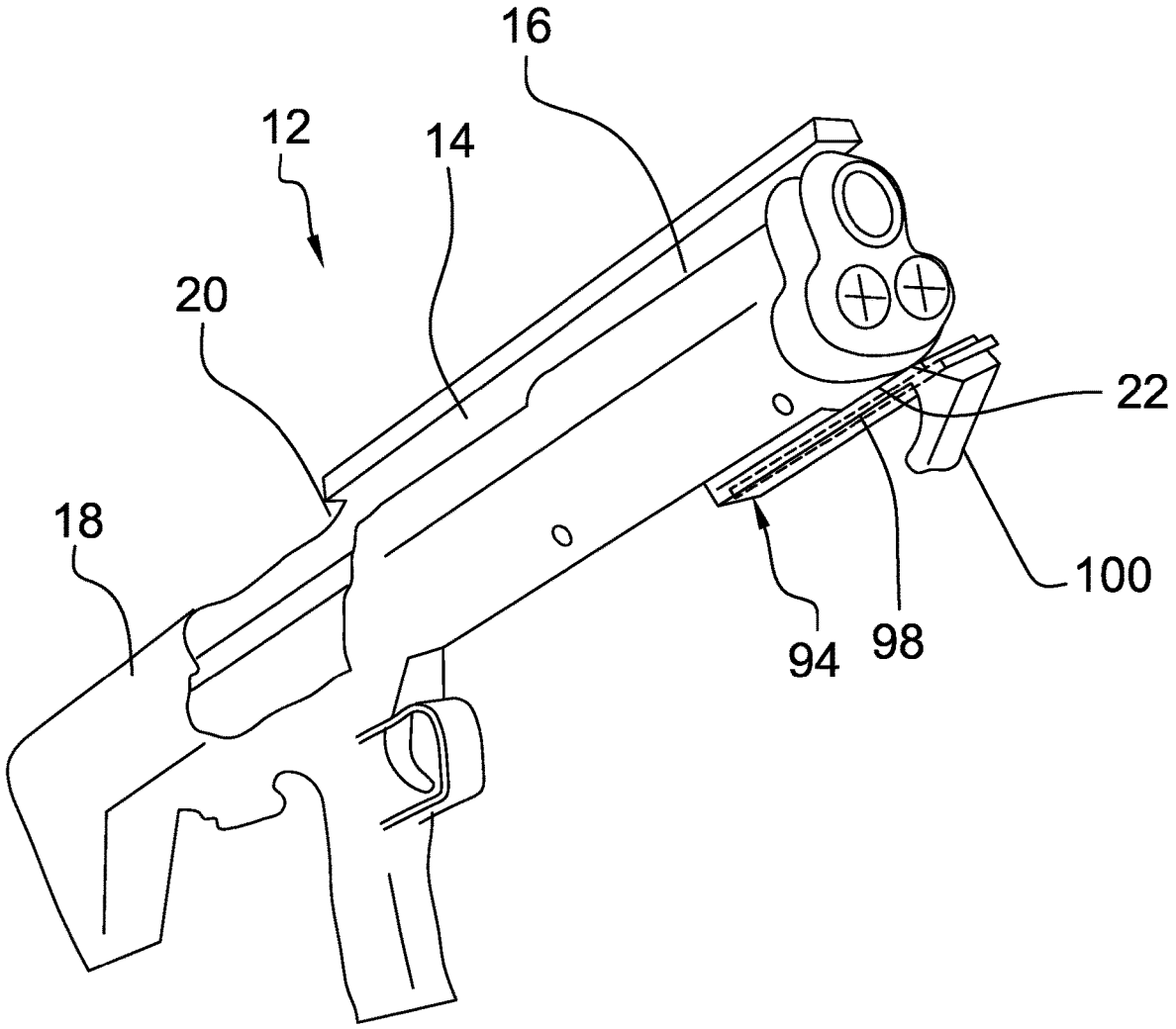
FIG. 7 is a detail view of an embodiment of the disclosure.
Figure 8:
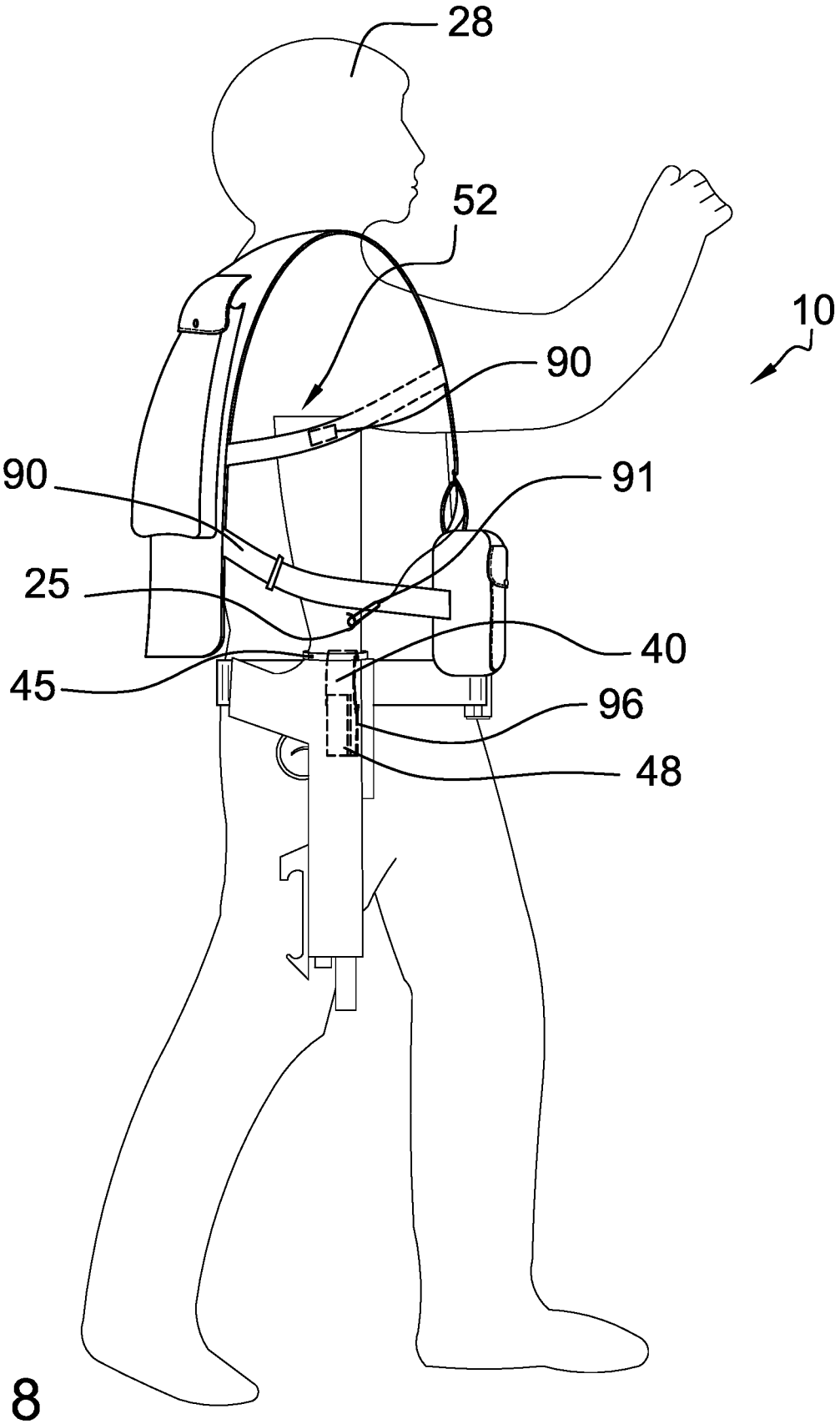
FIG. 8 is a side in-use view of an embodiment of the disclosure.
Figure 9:
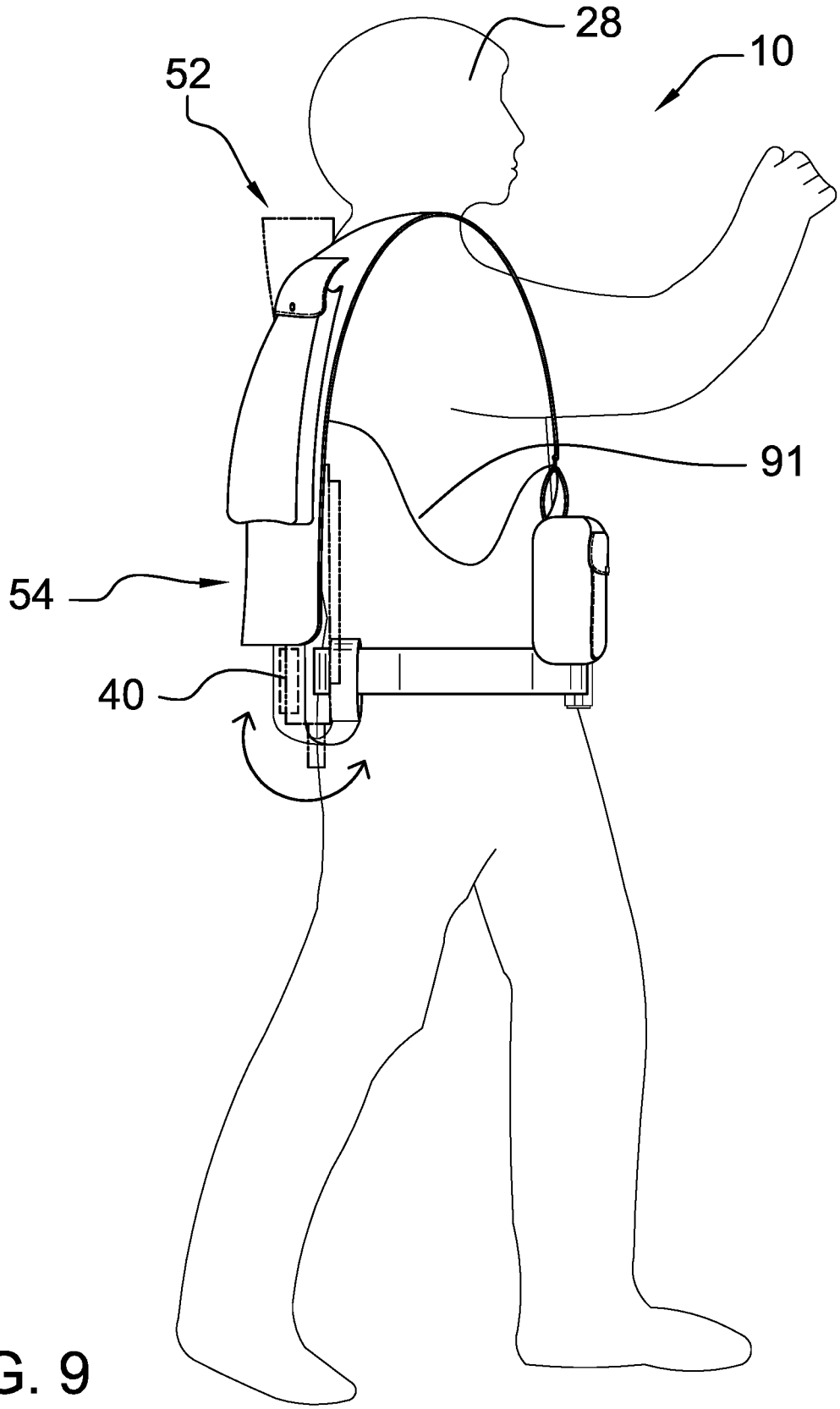
FIG. 9 is a rear in-use side view of an embodiment of the disclosure.
Figure 10:
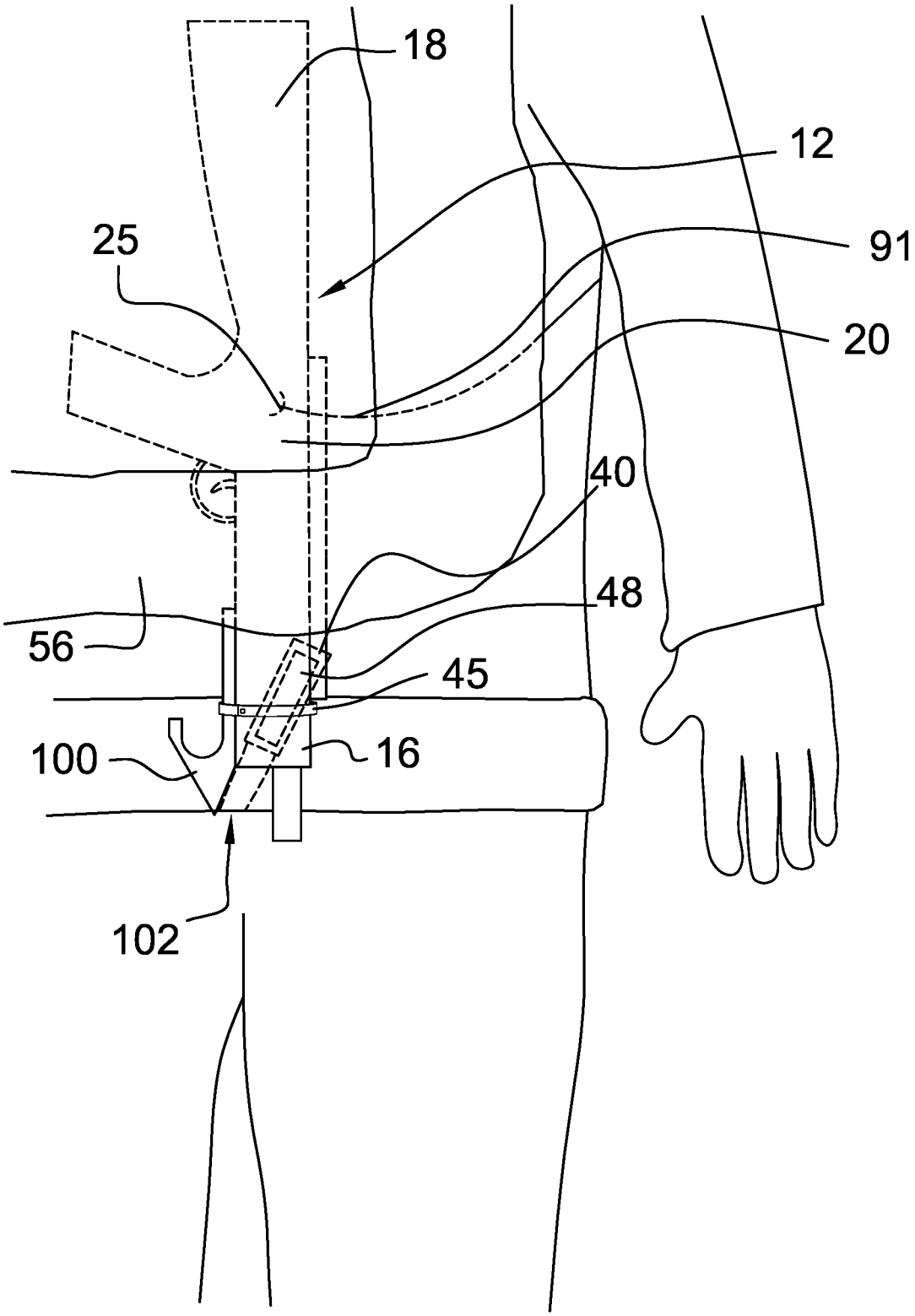
FIG. 10 is a rear in-use view of an embodiment of the disclosure.
Figure 11:
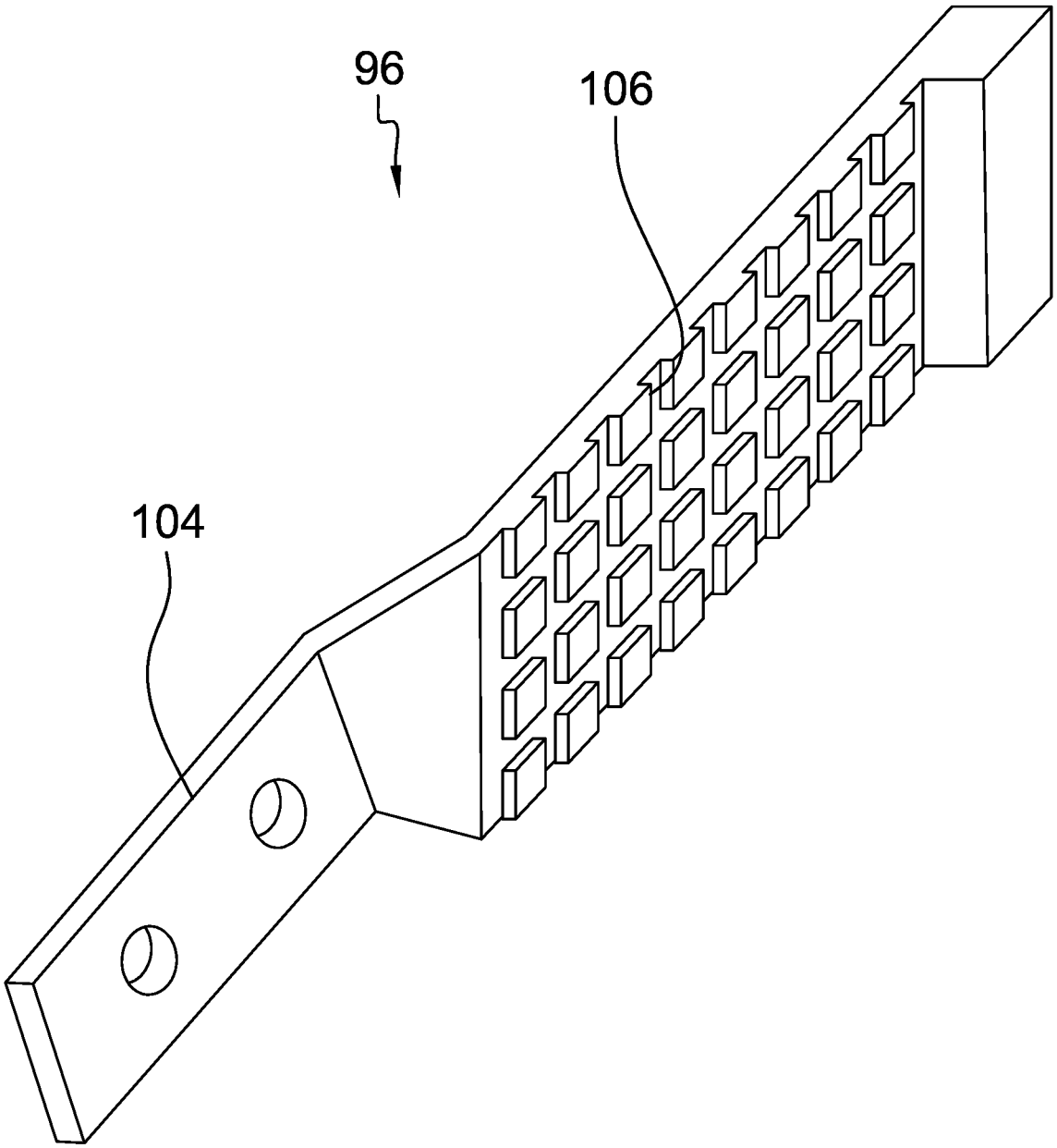
FIG. 11 is a detail view of an alternative embodiment of the disclosure.
Figure 12:
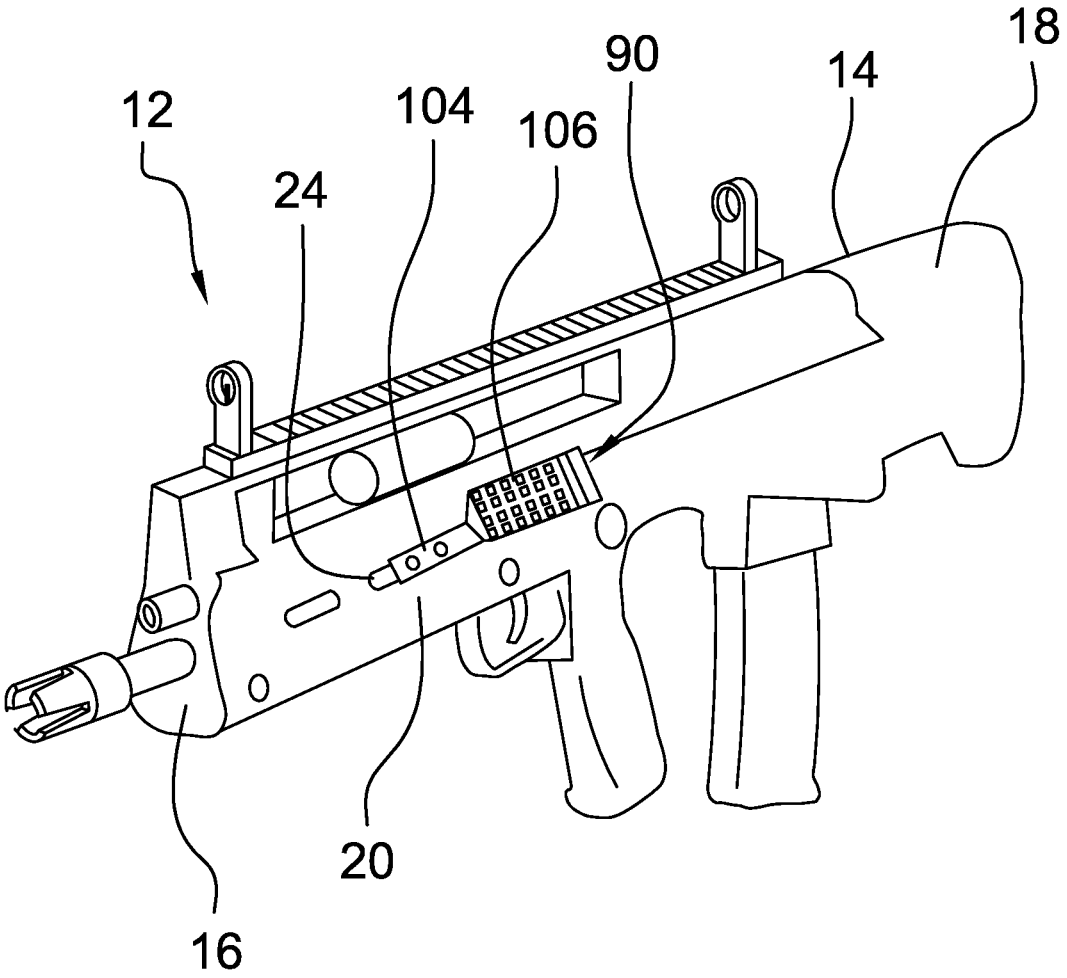
FIG. 12 is a detail view of an alternative embodiment of the disclosure.
Figure 13:
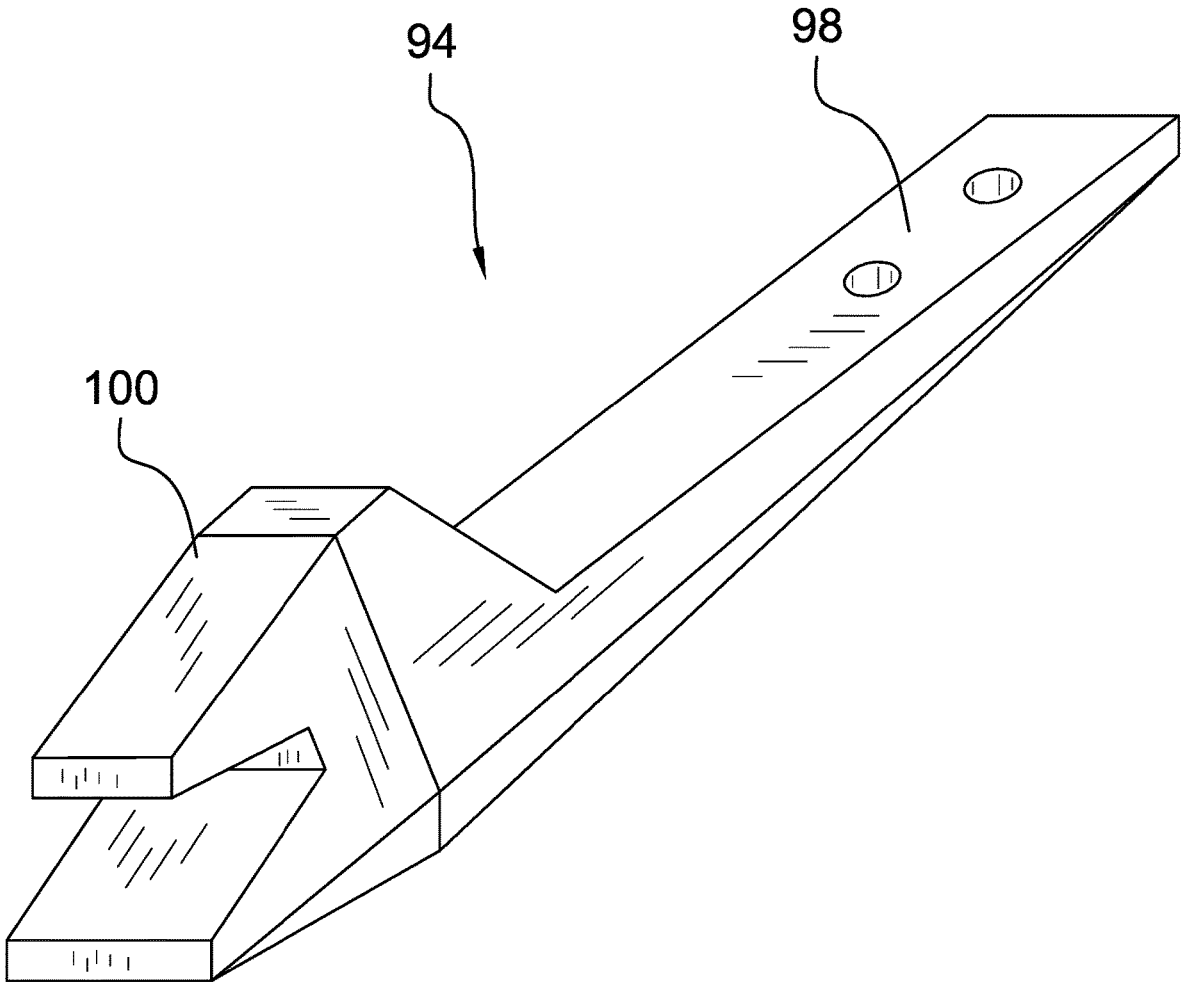
FIG. 13 is a detail view of an alternative embodiment of the disclosure.
Figure 14:
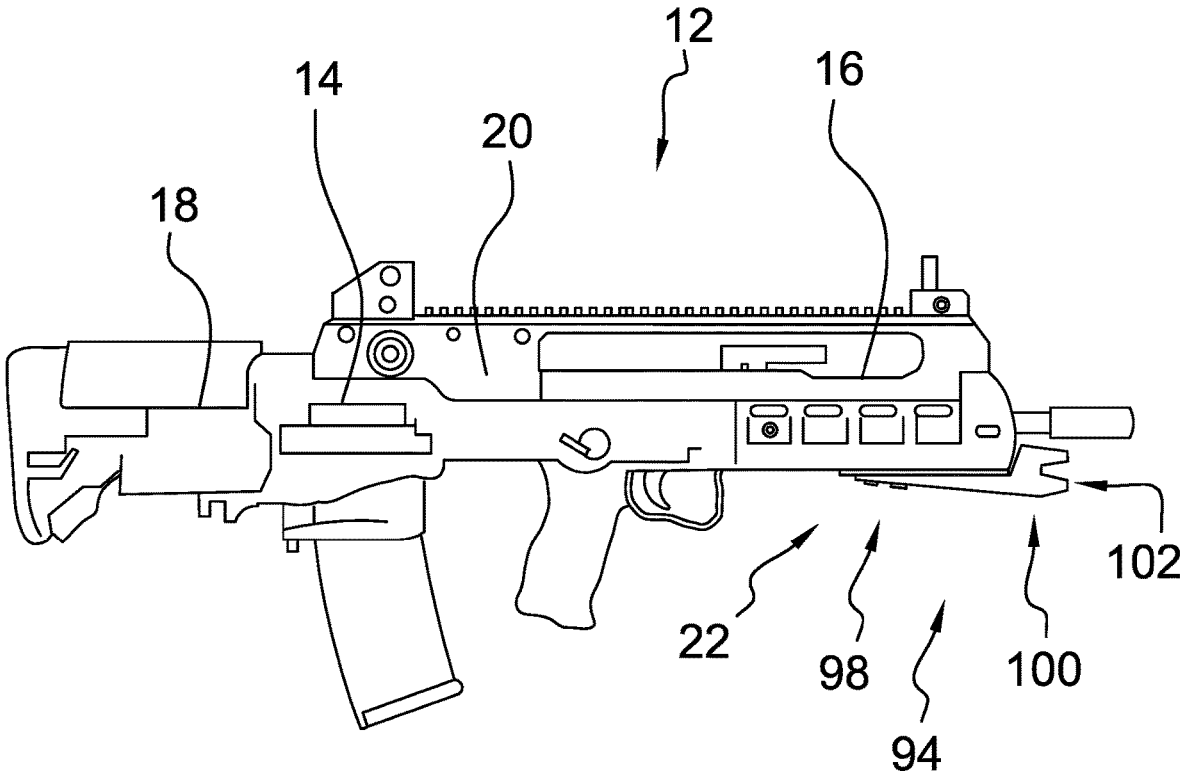
FIG. 14 is a detail view of an alternative embodiment of the disclosure.
Figure 15:
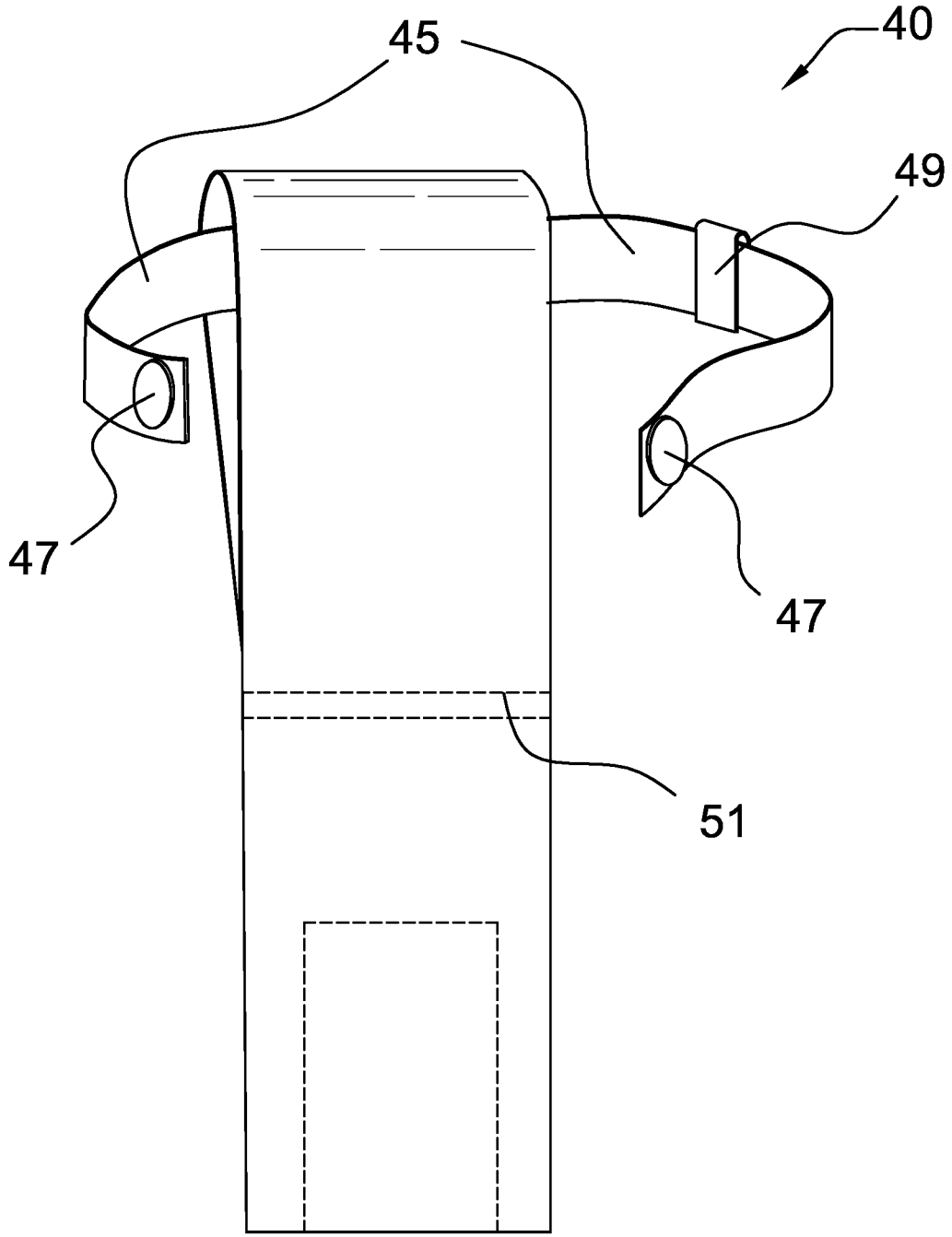
FIG. 15 is a detail view of an embodiment of the disclosure.

With reference now to the drawings, and in particular to FIGS. 1 through 15 thereof, a new firearm holster embodying the principles and concepts of an embodiment of the disclosure and generally designated by the reference numeral 10 will be described.

As best illustrated in FIGS. 1 through 15, the handless shoulder-fire firearm carry system 10 generally comprises a firearm 12. The firearm 12 includes a frame 14 having a first section 16, a second section 18, and a center section 20 positioned between the first section 16 and the second section 18. The frame 14 comprises a ferrous material, wherein the frame 14 is magnetically engageable. A front mount 22 comprised of non-ferrous metal or synthetic material is attached to the first section 16 of the frame 14 and a side mount 24 comprised of ferrous metal is attached to the center section 20 of the frame 14. The front mount 22 and the side mount 24 may both be picatinny rail mounts or another conventional firearm 12 attachment mount. A clip connector 25 is attached to the frame 14 of the firearm 12. The clip connector 25 is typically positioned on the center section 20 of the firearm 12. The firearm 12 may be a Keltec KSG, a Springfield Armory VHS 2, or some other conventional shoulder-fire style firearms 12.

A belt 26 is configured to be worn about a waist of a user 28. The belt 26 has a first end 30 and a second end 32. A clasp 34 is coupled to the belt 26 and releasably couples the first end 30 to the second end 32, wherein the clasp 34 forms the belt 26 into an enclosed loop. The clasp 34 includes a first clasp member 36 and a second clasp member 38 being engageable with each other. The first clasp member 36 is coupled to the first end 30 and the second clasp member 38 is coupled to the second end 32.

An anchor 40 is coupled to the belt 26 and is configured to secure the firearm 12 to the belt 26. The anchor 40 comprises an anchor strap 42 being elongated and having a top section 44 and a bottom section 46. The top section 44 is folded over and attaches to a middle of the strap 42 to form a beltloop, wherein the belt 26 is inserted through the beltloop to secure the anchor 40 to the belt 26. An anchor magnet 48 is positioned within the bottom section 46 of the anchor strap 42. The anchor magnet 48 is magnetically engageable with the frame 14 of the firearm 12 and is designed to slide on the belt 26 between a rear carry position 53 and a side carry position 55. The top section 44 has a securing strap 45 mounted laterally near a top end of the top section 44. The securing strap 45 typically has a width measuring between two centimeters to five centimeters. The securing strap 45 has a nonferrous snap closure 47 positioned on each end of the strap 45, wherein the securing strap 45 wraps about the firearm 12 and secures to itself by the nonferrous snap closure 47, thereby holding the firearm 12 in a secure position. The securing strap 45 has an adjustment member 49 allowing the user 28 to adjust a length of the securing strap 45.

An anchor wedge stop 51 comprising of a nonferrous metal or similarly stiff and unbending material is sewn into the anchor strap 42 and is positioned laterally relative to the anchor strap 42 where the top section 44 and the bottom section 46 meet. The anchor wedge stop 51 has a thickness measuring between half a centimeter to one centimeter and a depth measuring the same as the anchor strap 42. The anchor wedge stop 51 is engageable with the front mount 22 in the rear carry position 53.

A vest 50 is configured to be worn on a torso of the user 28. The vest 50 holds the firearm 12 in a downward position 52 relative to the user 28. The rear carry position 53 is defined by the second section 18 and the center section 20 of the firearm 12 being positioned between the user 28 and the vest 50 and the first section 16 of the firearm 12 being attached to the anchor 40 at the rear of the user 28. The side carry position 55 is defined by the center 20 and second 18 sections of the firearm 12 being positioned between the user 28 and the vest 50 and the center section 20 of the firearm 12 being attached to the anchor 40 at a side of the user 28. The vest 50 includes a rear section 54 comprising a back covering 56 configured to lie against a back of the user 28. The back covering 56 has a top edge 58, a bottom edge 60, a first side edge 62, and a second side edge 64.

A front section 66 is attached to the rear section 54 and comprises a first flap 68 positioned adjacent to the first side edge 62 and a second flap 70 positioned adjacent to the second side edge 64. The first flap 68 and the second flap 70 each are attached to the top edge 58 of the back covering 56, and the first flap 68 and the second flap 70 are configured to fold over a respective shoulder of a pair of shoulders of the user 28 to form the vest 50. The first flap 68 and the second flap 70 each may have one of a pair of adjustment members 71 to adjust a length of the first flap 68 and the second flap 70. The first flap 68 and the second flap 70 each are releasably attached to each other by a fastener 72. The fastener 72 includes a first elongated member 74 extending out from the first flap 68 and a second elongated member 76 extending out from the second flap 70. The first elongated member 74 has a first fastening member 78 and the second elongated member 76 has a second fastening member 80, wherein the first fastening member 78 is releasably engageable with the second fastening member 80 to couple the first elongated member 74 to the second elongated member 76.

A plurality of pockets 82 is attached to the vest 50. The pockets 82 are positioned on the first flap 68, the second flap 70, and the back covering 56. Each of the pockets 82 are configured to hold firearm related articles such as ammunition. A plurality of tethers 84 couples the front section 66 to the rear section 54. A pair of first tethers 86 of the plurality of tethers 84 is attached to the first flap 68 and to the first side edge 62 of the back covering 56. A second tether 88 of the plurality of tethers 84 is attached to the second flap 70 and to the second side edge 64 of said back covering 56. A pair of magnetic members 90 is coupled to the vest 50. One of the magnetic members 90 is coupled to one of the pair of first tethers 86 and one of the magnetic members 90 is coupled to the first flap 68 of the front section 66. Each of the magnetic members 90 magnetically engages with the second section 18 and the center section 20 of the firearm 12 when the firearm 12 is held by the vest 50 in the side carry position 55. A clip 91 is attached to the first flap 68 of the front section 66. The clip 91 releasably attaches to the clip connector 25 of the frame 14 of the firearm 12, wherein the clip 91 latches the firearm 12 to the vest 50.

A pair of securing attachments 92 is coupled to the firearm 12. Each of the securing attachments 92 are configured to facilitate securing the firearm 12 to the anchor 40. The pair of securing attachments 92 includes a first securing attachment 94 and a second securing attachment 96. The first securing attachment 94 facilitates rear carry by securing the first section 16 or the second section 18 of the firearm 12 to the anchor 40 positioned at the rear of the user 28. The first securing attachment 94 includes a first mounting member 98 and a foregrip 100 attached to a tip of the first mounting member 98. The first mounting member 98 is secured to the front mount 22 of the firearm 12, and the foregrip 100 and the firearm 12 form a wedge space 102 when the first securing attachment 94 is attached to the firearm 12, wherein the wedge space 102 supports the anchor strap 42 of the anchor 40 when the anchor magnet 48 is attached to the first section 16 of the firearm 12.

The second securing attachment 96 facilitates side carry by securing the center section 20 of the firearm 12 to the anchor 40 positioned at the side of the user 28. The second securing attachment 96 includes a second mounting member 104 and a grip 106 attached to the second mounting member 104. The second mounting member 104 is secured to the side mount 24 of the firearm 12. The grip 106 of the second securing attachment 96 is ferrous metal, wherein the grip 106 magnetically engages with the anchor magnet 48. The grip 106 is textured to facilitate securing to the anchor 40 by friction when the anchor 40 is magnetically engaged with the grip 106.

In use, the pair of securing attachments 92 are attached to the firearm 12. The first securing attachment 94 is mounted to the front mount 22 of the firearm 12. The bottom section 46 of the anchor 40 is inserted in the wedge space 102 formed between the first securing attachment 94 and the first section 16 of the firearm 12 prior to magnetically attaching the anchor magnet 48 to the firearm 12. The second section 18 of the firearm 12 is held between the torso of the user 28 and the rear section 54 of the vest 50. Alternatively, the anchor 40 magnetically engages with the grip 106 of the second securing attachment 96 when the second securing attachment 96 is attached to the side mount 24 of firearm 12. The second section 18 of the firearm 12 is positioned between the torso of the user 28 and the pair of first tethers 86 of the vest 50. The pair of magnetic members 90 of the vest 50 magnetically engage with the second section 18 of the firearm 12 to facilitate holding the firearm 12 to the user 28.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A firearm holster system comprising:

a firearm, said firearm including;

a frame having a first section, a second section, and a center section positioned between said first section and said second section, wherein said frame comprises a ferrous material, wherein said frame is magnetically engageable;

a belt being configured to be worn about a waist of the user;

an anchor being coupled to said belt and being configured to secure said firearm to said belt;

a vest being configured to be worn on a torso of the user, said vest holding said firearm in a downward position relative to the user, a rear carry position being defined by said second section and said center section of said firearm being positioned between said user and said vest and said first section of said firearm being attached to said anchor at the rear of the user, a side carry position being defined by said center section and said second section being positioned between the user and said vest and said center section of said firearm being attached to said anchor positioned at a side of the user;

a pair of securing attachments being coupled to said firearm, each of said securing attachments being configured to facilitate securing said firearm to said anchor, said pair of securing attachments including:

a first securing attachment facilitating rear carry by securing said first section of said firearm to said anchor positioned at a rear of the user; and a second securing attachment facilitating front and side carry by securing said center section of said firearm to said anchor positioned at a front or a side of the user; and wherein said anchor comprising an anchor strap being elongated and having a top section and a bottom section, said top section being folded over and attaching to a middle of said anchor strap to form a beltloop, wherein said belt is inserted through said beltloop to secure said anchor to said belt, an anchor magnet being positioned within said bottom section of said anchor strap, said anchor magnet being magnetically engageable with said frame of said firearm and with said center mount.

2. The firearm holster system of claim 1, further including a front mount being attached to said first section of said frame, a side mount being attached to said center section of said frame, a clip connector being attached to said frame.

3. The firearm holster system of claim 1, wherein said belt having a first end and a second end, a clasp being coupled to said belt and releasably coupling said first end to said second end, wherein said clasp forms said belt into an enclosed loop, said clasp including a first member and a second member being engageable with each other, said first member being coupled to said first end, said second member being coupled to said second end.

4. The firearm holster system of claim 1, wherein said anchor includes a securing strap, said securing strap being adjustably elongated, said securing strap being mounted to a top end of said top section of said anchor strap and being positioned laterally relative to said anchor strap, said securing strap having a fastener on each end of a pair of ends of said securing strap, wherein said pair of ends being releasably securable with each other, said anchor including a wedge stop, said wedge stop being elongated and comprising nonferrous material, said wedge stop being positioned between said top and bottom sections of said anchor strap, said wedge stop being engageable with said front mount such that said wedge stop allows said rear carry position, said wedge stop having a thickness measuring half a centimeter and a height measuring half a centimeter.

5. The firearm holster system of claim 2, wherein said vest including a rear section, said rear section comprising a back covering being configured to lie against a back of the user, said back covering having a top edge, a bottom edge, a first side edge, and a second side edge.

6. The firearm holster system of claim 5, further including a front section being attached to said rear section, said front section comprising a first flap being positioned adjacent to said first side edge and a second flap being positioned adjacent to said second side edge, said first flap and said second flap each being attached to said top edge of said back covering, said first flap and said second flap being configured to fold over a respective shoulder of a pair of shoulders of the user to form said vest, said first flap and said second flap each being releasably attached to each other by a fastener, a plurality of pockets being attached to said vest, said pockets being positioned on said first flap, said second flap, and said back covering, each of said pockets being configured to hold firearm related articles.

7. The firearm holster system of claim 6, further including a plurality of tethers coupling said front section to said rear section, a pair of first tethers of said plurality of tethers being attached to said first flap and to said first side edge of said back covering, a second tether of said plurality of tethers being attached to said second flap and to said second side edge of said back covering.

8. A firearm holster system comprising:

a firearm, said firearm including;

a frame having a first section, a second section, and a center section positioned between said first section and said second section;

a belt being configured to be worn about a waist of the user;

an anchor being coupled to said belt and being configured to secure said firearm to said belt;

a vest being configured to be worn on a torso of the user, said vest holding said firearm in a downward position relative to the user, a rear carry position being defined by said second section and said center section of said firearm being positioned between said user and said vest and said first section of said firearm being attached to said anchor at the rear of the user, a side carry position being defined by said center section and said second section being positioned between the user and said vest and said center section of said firearm being attached to said anchor positioned at a side of the user;

a pair of securing attachments being coupled to said firearm, each of said securing attachments being configured to facilitate securing said firearm to said anchor, said pair of securing attachments including:

a first securing attachment facilitating rear carry by securing said first section of said firearm to said anchor positioned at a rear of the user; and a second securing attachment facilitating front and side carry by securing said center section of said firearm to said anchor positioned at a front or a side of the user;

wherein said frame comprises a ferrous material, wherein said frame is magnetically engageable;

a front mount being attached to said first section of said frame, a side mount being attached to said center section of said frame, a clip connector being attached to said frame;

wherein said vest including a rear section, said rear section comprising a back covering being configured to lie against a back of the user, said back covering having a top edge, a bottom edge, a first side edge, and a second side edge;

a front section being attached to said rear section, said front section comprising a first flap being positioned adjacent to said first side edge and a second flap being positioned adjacent to said second side edge, said first flap and said second flap each being attached to said top edge of said back covering, said first flap and said second flap being configured to fold over a respective shoulder of a pair of shoulders of the user to form said vest, said first flap and said second flap each being releasably attached to each other by a fastener, a plurality of pockets being attached to said vest, said pockets being positioned on said first flap, said second flap, and said back covering, each of said pockets being configured to hold firearm related articles;

a plurality of tethers coupling said front section to said rear section, a pair of first tethers of said plurality of tethers being attached to said first flap and to said first side edge of said back covering, a second tether of said plurality of tethers being attached to said second flap and to said second side edge of said back covering; and a pair of magnetic members, one of said magnetic members being coupled to one of said pair of first tethers, one of said magnetic members being coupled to said first flap of said front section, each of said magnetic members magnetically engaging with said second section of said firearm when said firearm is held by said vest in said side carry position.

9. The firearm holster system of claim 8, further including a clip being attached to said first flap of said front section, said clip releasably attaching to said clip connector of said frame of said firearm, wherein said clip latches said firearm to said vest.

10. The firearm holster system of claim 4, wherein said first securing attachment includes a first mounting member and a foregrip attached to said first mounting member, said first mounting member being secured to said front mount of said firearm, said foregrip and said firearm forming a wedge space when said first securing attachment being attached to said firearm, wherein said wedge space supports said anchor strap of said anchor when said anchor magnet is attached to said first section of said firearm.

* * * * *